US007018421B2

(12) United States Patent
Nakashima

(10) Patent No.: US 7,018,421 B2
(45) Date of Patent: Mar. 28, 2006

(54) PROCESS FOR DYEING SYNTHETIC HAIR

(75) Inventor: Hiroyuki Nakashima, Kakogawa (JP)

(73) Assignee: Kaneka Corporation, Osaka (JP)

( * ) Notice: Subject to any disclaimer, the term of this patent is extended or adjusted under 35 U.S.C. 154(b) by 199 days.

(21) Appl. No.: 10/343,589

(22) PCT Filed: Jul. 27, 2001

(86) PCT No.: PCT/JP01/06493

§ 371 (c)(1),
(2), (4) Date: Apr. 18, 2003

(87) PCT Pub. No.: WO02/09543

PCT Pub. Date: Feb. 7, 2002

(65) Prior Publication Data

US 2003/0154564 A1 Aug. 21, 2003

(30) Foreign Application Priority Data

Jul. 31, 2000 (JP) ..... 2000-231943

(51) Int. Cl.
*D06M 23/10* (2006.01)

(52) U.S. Cl. ..... 8/115.51; 8/115.54; 8/115.56; 8/116.4; 8/127.6; 424/70.6; 132/208

(58) Field of Classification Search ..... 8/115.51, 8/116.4, 127.6, 115.54, 115.56; 424/70.6; 132/208
See application file for complete search history.

(56) References Cited

U.S. PATENT DOCUMENTS 3,700,399 A * 10/1972 Shimauchi et al. ..... 8/606
4,131,424 A * 12/1978 Cocoros et al. ..... 8/582

FOREIGN PATENT DOCUMENTS

| | | | |
|---|---|---|---|
| JP | 44-15200 B1 | | 7/1969 |
| JP | 57-16981 A | | 1/1982 |
| JP | 9-31842 A | | 2/1997 |
| JP | 10-121385 A | | 5/1998 |
| WO | WO 89/05104 A1 | | 6/1989 |
| WO | WO 8905104 | * | 6/1989 |

OTHER PUBLICATIONS

Einglish abstract of the japanese Patent No. (JP 69015200 B) 1968.*
English Translation of International Preliminary Examination Report Corresponding to International Application No. PCT/JP01/06493 From the International Bureau Dated Oct. 7, 2002.
International Search Report Corresponding to International Application No. PCT/JP01/06493 From the Japanese Patent Office Dated oct. 22, 2001.

* cited by examiner

*Primary Examiner*—Eisa Elhilo
(74) *Attorney, Agent, or Firm*—Brinks Hofer Gilson & Lione

(57) ABSTRACT

The present invention relates to a process for preparing synthetic hair fiber comprising halogen-containing synthetic fiber, in which synthetic hair fiber can be evenly dyed at a low temperature in a short period, maintaining excellent fastness, without abnormal shrinking (frizzing) and embrittlement of the fiber due to swelling.

The object is attained by dipping the synthetic hair fiber bundle in a solution containing a dye, a carrier (accelerating agent) and a solvent for halogen-containing fiber, and then dyeing at 60° to 90° C.

5 Claims, 3 Drawing Sheets

PROCESS FOR DYEING SYNTHETIC HAIR

RELATED APPLICATIONS

This application is a nationalization of PCT Application No. PCT/JP01/6493 filed Jul. 27, 2001, and not published in English. This application claims priority from the PCT application and Japanese Application Serial No. 2000-231943 filed Jul. 31, 2000.

TECHNICAL FIELD

The present invention relates to a process for preparing synthetic hair fiber used in hair goods such as wigs, hair accessories, weavings and braids.

BACKGROUND ART

As synthetic hair fiber, halogen-containing synthetic fibers such as modacrylic fiber and poly(vinyl chloride) fiber with excellent flame retardancy are widely used. However, because these halogen-containing synthetic fibers have low heat resistance, by dyeing at high temperatures and for long hours damage by heat such as frizz and shrinking of the ends tends to occur. Multi-color dyeing especially tends to damage fibers as it repeats dyeing. In order to reduce damage by heat, methods to evenly dye at a low temperature or in a short period have been considered. For example, in JP-A-57-16981, a method of using a carrier (accelerating agent) has been disclosed, and in JP-A-10121385, a method of using a solvent such as acetone has been disclosed. Although both enable dyeing in a short period, fastness (lightfastness, color fastness to rubbing) is insufficient and, when used in large amounts, there is the problem of abnormal -shrinking (frizzing) or embrittlement of the fiber due to swelling. Furthermore, in JP-A-01-174683, a method for multi-color dyeing of synthetic hair fiber is disclosed, but because the fiber is dipped multiple times into the dyeing solution at a temperature of 80 to 90° C., which is lower than usual, there is the problem of the dyeing process taking a long time.

The present invention solves the problems of the prior art. That is, the present invention provides a process for preparing synthetic hair fiber in which the fiber can evenly be dyed at a low temperature in a short period while maintaining excellent fastness without abnormal shrinking (frizzing) or embrittlement of the fiber due to swelling.

DISCLOSURE OF INVENTION

As a result of intensive studies to solve the above problems, it has been found that fiber can be dyed evenly with an extremely small amount of solvent by using a carrier and a solvent for synthetic fiber together, as compared to the prior art's using each of them independently. It was also found that because a small amount of solvent is used, abnormal shrinking (frizzing) and embrittlement of the fiber due to swelling does not occur easily and thus the present invention has been accomplished.

That is, the present invention relates to a process for dyeing synthetic hair fiber which comprises dyeing a bundle of synthetic hair fiber made of halogen-containing synthetic fiber by using a dyeing solution containing a dye, a carrier and a solvent for the synthetic fiber at 60° to 90° C.

It is preferable that the carrier is used in an amount of 0.05 to 1.2% by weight based on the dyeing solution and the solvent is used in an amount of 0.05 to 5% by weight based on the dyeing solution.

Preferably, the halogen-containing synthetic fiber is selected from the group consisting of halogen-containing vinyl fiber and modacrylic fiber.

It is preferable that a synthetic fiber bundle which is dyed is further dyed partially to dye in multiple colors.

The carrier is preferably at least one member selected from the group consisting of aromatic ester type, aromatic ester type, methyl naphthalene type and N-alkylphthalimide type.

The solvent is preferably at least one member selected from the group consisting of acetone, ethylene carbonate, tetrahydrofuran, dimethylformamide (DMF), dimethylacetamide (DMAc) and dimethyl sulfoxide (DMSO).

BEST MODE FOR CARRYING OUT THE INVENTION

Figure 1:
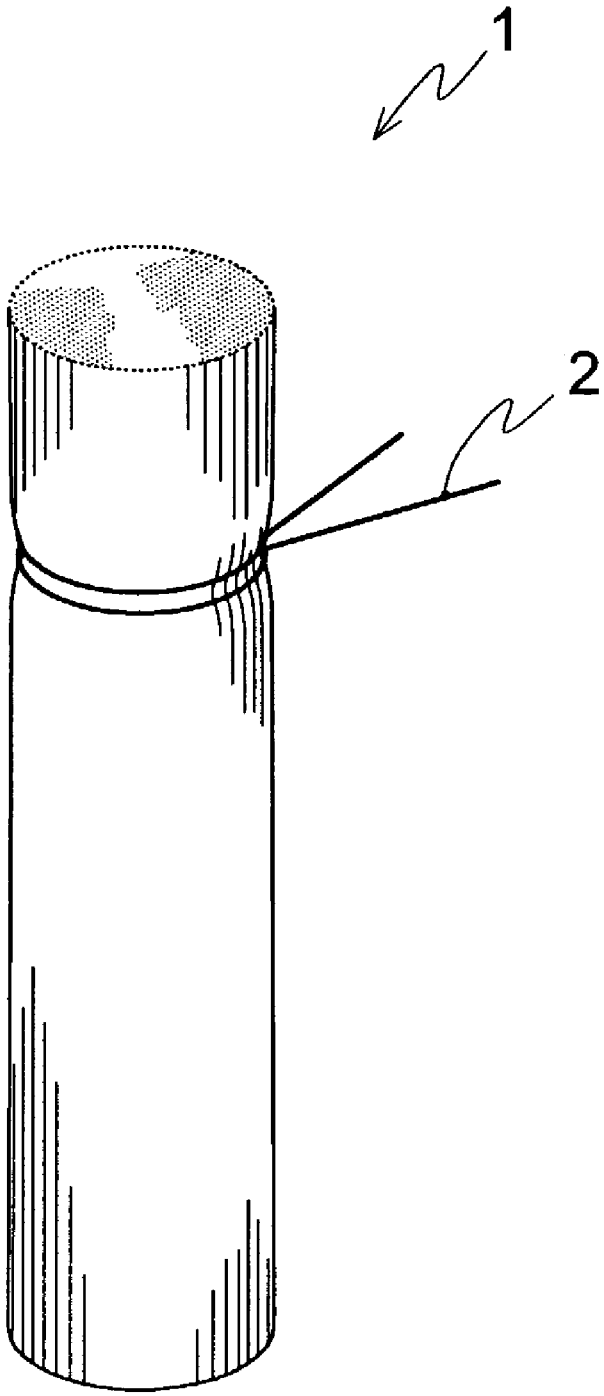
FIG. 1 is a view illustrating the state of binding of the synthetic hair fiber bundle when dyeing according to the present invention.

The present invention is described in detail below.

The halogen-containing synthetic fiber which can be used in the present invention is not particularly limited, but preferably comprises poly(vinyl chloride) fiber or modacrylic fiber which is widely used as synthetic hair fiber. The modacrylic fiber mentioned here refers to a copolymer of 30 to 80% by weight of acrylonitrile, 70 to 30% by weight applied to halogen-containing vinyl fiber such as poly(vinyl chloride) fiber and cation dye can be applied to modacrylic fiber.

The carrier (accelerating agent) used in the present invention is an organic compound hardly soluble in water, and is applied to the fiber after being evenly dispersed in water by emulsifying with an emulsifier. The carrier is not particularly limited but is preferably at least one member selected from the group consisting of aromatic ether type, aromatic ester type, methyl naphthalene type and N-alkylphthalimide type. Among these, from the viewpoint that the swelling effect is moderate and shrinking does not occur, cyanobenzylether compound, acetophenone and N-butylphtalmide used for halogen-containing synthetic fiber is more preferable.

The amount of the carrier to be used is preferably 0.05 to 1.2% by weight and more preferably 0.08 to 1.0% by weight based on the dyeing solution. In the case that the amount of the carrier to be used is less than 0.05% by weight based on the dyeing solution, dyeing evenly at a low temperature in a short period tends to become difficult. In the case that the amount of the carrier used exceeds 1.2% by weight based on the dyeing solution, abnormal shrinking and embrittlement of the fiber due to swelling tend to occur.

The solvent to be used together with the carrier is a water soluble organic compound and is applied to the fiber after dissolving in water. It is preferable that the solvent easily dissolves halogen-containing synthetic fiber and is at least one member selected from the group consisting of acetone, ethylene carbonate, tetrahydrofuran, dimethylformamide (DMF), dimethylacetamide (DMAc) and dimethyl sulfoxide (DMSO).

The amount of the solvent to be used is preferably 0.05 to 5% by weight based on the dyeing solution, more preferably 0.1 to 5% by weight based on the dyeing solution. In the case that the amount of the solvent to be used is less than 0.05% by weight based on the dyeing solution, the effects of using together with a carrier, in other words evenly dyeing at a low temperature in a short period and improving fastness, tend to become difficult. In the case that the amount of the solvent used exceeds 5% by weight based on the dyeing solution, abnormal shrinking and embrittlement of the fiber due to swelling tend to occur.

The temperature of the dyeing solution is 60° to 90° C., preferably 70° to 85° C. In the case that the temperature of the dyeing solution is lower than 60° C., dyeing to the predetermined color becomes difficult. In the case that the temperature of the dyeing solution exceeds 90° C., abnormal shrinking and embrittlement of the fiber occur. The pH of the dyeing solution is preferably adjusted to pH 3 to 6 by using a known acids as usual.

The dyeing process of the present invention is especially useful when the synthetic fiber bundle which has been dyed once is partially dyed further to dye in multiple colors, for example, in the case that the end part of the fiber and the rest of the fiber are to be dyed in different colors (two-tone), as dyeing can be conducted in an extremely short period.

The synthetic hair fiber bundle to be dyed and the dyeing process is explained referring to the figures.

Figure 2:
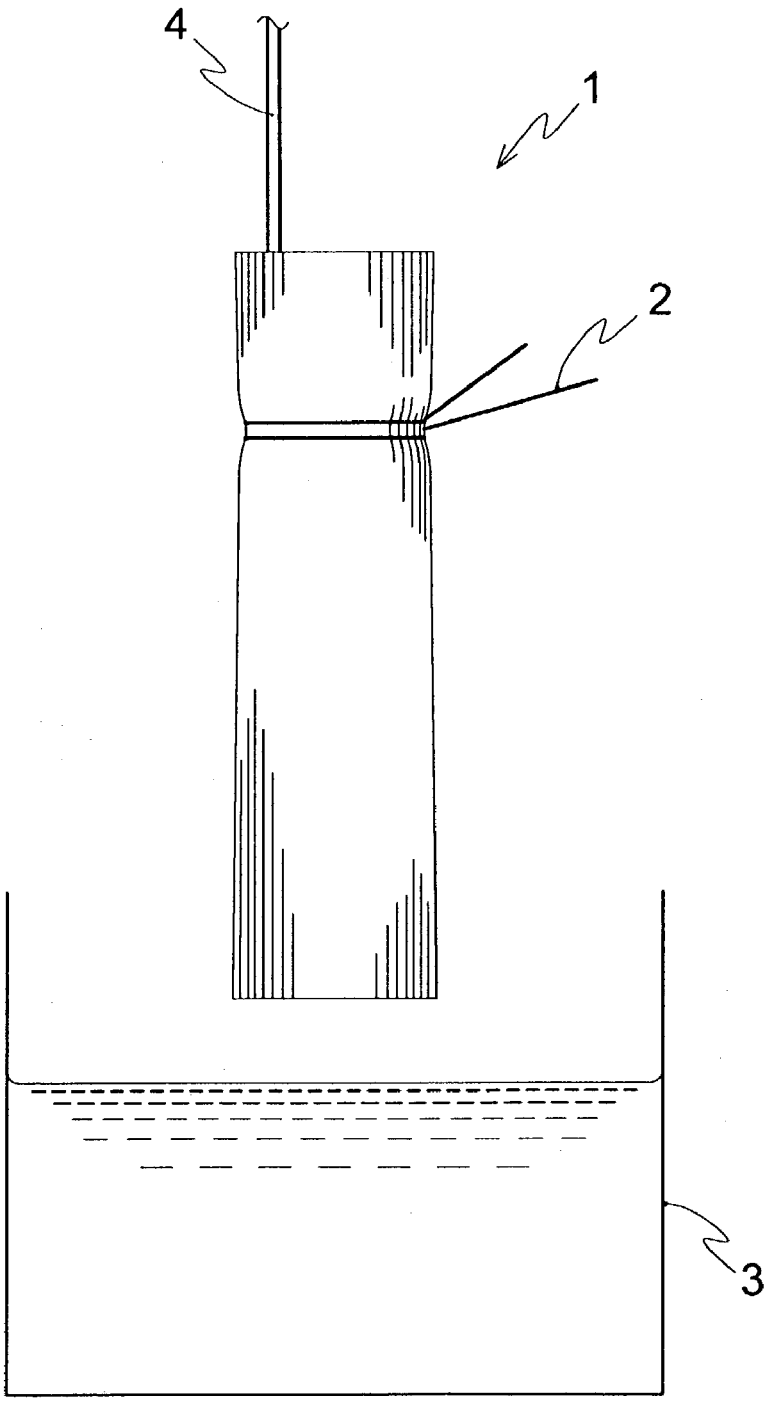
FIG. 2 is a view illustrating an example of the synthetic hair fiber bundle being hung in the upper part of the dyeing bath.
Figure 3:
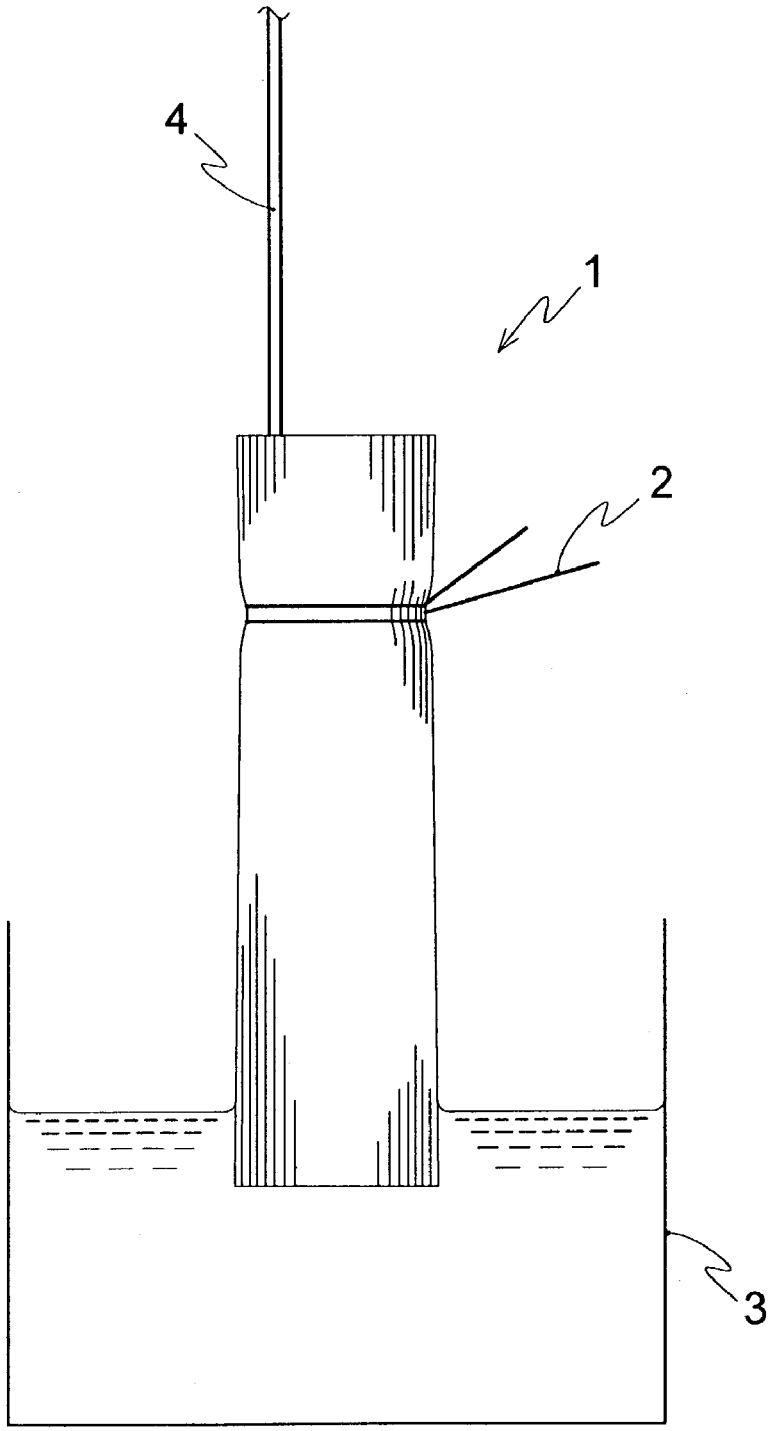
FIG. 3 is a view illustrating the state of the hung synthetic hair fiber bundle being dipped.

As indicated in FIG. 1, synthetic hair fiber made of halogen-containing synthetic fiber was bundled to create a hair bundle of 5 to 50 mm in diameter (10,000 to 1,000,000 fibers) and then cut to a uniform size of 10 to 100 cm in length. One end of this bundle is tied together with a cord or rubber band 2 to make bundle 1. The diameter of bundle 1 is preferably set to the diameter of the tow of the synthetic fiber maker. This allows simplifying of the production steps as the fiber can be taken out of the carton box, cut just as it is and made into a hair bundle. Furthermore, in determining the length of hair bundle 1, the length of hair of the hair product to be produced should be taken into consideration. Next, as indicated in FIG. 2, in the upper part of temperature controllable dyeing bath 3 which is equipped with hanging part 4, hair bundle 1 is hung by the hanging part 4. Then, as indicated in FIG. 3, the hair bundle is dipped to be dyed to the desired length. And by providing vertical or vertical and horizontal movement when dyeing, dyeing of the desired part becomes possible. After dyeing, synthetic hair fiber bundle 1 is taken out of dyeing bath 3 and washed with water or warm water until the dyeing solution becomes colorless and transparent. In this case, washing is preferably done with a penetrant. After dehydration, oil solution (conditioner) for synthetic fiber is applied accordingly and the hair bundle is dried in an oven.

Hereinafter, the present invention is described in detail by means of Examples, but not limited thereto. The evaluation methods in Examples are as defined below.

(Proportion of the Remnant Dye After Dyeing)

The concentration of the dye solution before dyeing which was adjusted according to the dye recipe of the targeted color was set to 100%, and solutions of this, diluted by water, for example, to 50%, 25%, and 10% were made and used as a standard. The remaining solution after dyeing and the standard solution were visually compared to judge the concentration of the remaining solution.

(Shrinking After Dyeing)

The shrinking condition of the fiber bundle after dyeing was evaluated in the following 3 levels.

○: no frizz

Δ: some frizz, but texture is not bad and usable

X: great deal of frizz, rough texture (Lightfastness)

The lightfastness was evaluated in accordance with JIS L0843.

(Color Fastness to Rubbing)

The color fastness to rubbing was evaluated in accordance with JIS L0849 by friction tester II (Gakushin type).

EXAMPLE 1

Using modacrylic fiber (Kanekalon KL-S available from Kaneka Corporation, fineness 53 dtex, color number 88), hair bundle 1 of a hair length of 30 cm and weight of 400 g (25,000 fibers) was made. One end of the hair bundle was tied and fixed with cord 2 as illustrated in FIG. 2, and then the hair bundle was hung in the upper part of the dyeing bath 3 by the hanging part 4. A dyeing solution comprising 0.282 owf of MAXILON Golden Yellow, 0.090 owf of MAXILON Red GRL and 0.228 owf of MAXILON Blue GRL which are cation dye (all available from Ciba-Geigy Corporation), totaling 0.6% owf, 0.24 g of Teonol AT (available from Meisei Kagaku Kabushiki Kaisha, aromatic ether type) which is a carrier, 2.4 g of ethylene carbonate which is a solvent for modacrylic fiber and 797 g of water, based on 20 g of the hair bundle to be dyed, was produced in dyeing bath 3. The pH was adjusted to pH 4 using acetic acid. This solution was then heated to 84° C. As indicated in FIG. 3, hair bundle 1 which was hung was gradually lowered and dipped 15 cm into the aforesaid dyeing solution. The dipped hair bundle 1 was then dyed for 30 minutes, while applying vibration in an amplitude of 28 mm at a rate of 120 times/minute. After processing, hair bundle 1 was taken out of dyeing bath 3 and washed for 1 minute with warm water of 60° to 70° C. Furthermore, after washing with warm water of 40° to 50° C. with a suitable amount of neutral detergent for domestic use dissolved into it, hair bundle 1 was washed with water and dehydrated. Then, the hair bundle was dried for 40 minutes in an oven (made by Tabai Espec Corporation) of 80° C.

Using this hair bundle, according to the evaluation method mentioned above, the proportion of the remnant dye after dyeing, shrinking, lightfastness and color fastness of rubbing were evaluated. The results are as shown in Table 1.

EXAMPLE 2

The experiment was conducted in the same manner as in Example 1 except that a dyeing solution comprising 3.2 g of Teonol AT (available from Meisei Kagaku Kabushiki Kaisha, aromatic ether type) which is a carrier, 2.4 g of ethylene carbonate which is a solvent for modacrylic fiber and 794 g of water was prepared. The results are shown in Table 1.

EXAMPLE 3

The experiment was conducted in the same manner as in Example 1 except that a dyeing solution comprising 5.6 g of Teonol AT (available from Meisei Kagaku Kabushiki Kaisha, aromatic ether type) which is a carrier, 2.4 g of ethylene carbonate which is a solvent for modacrylic fiber and 792 g of water was prepared. The results are shown in Table 1.

EXAMPLE 4

The experiment was conducted in the same manner as in Example 1 except that a dyeing solution comprising 8.0 g of Teonol AT (available from Meisei Kagaku Kabushiki Kaisha, aromatic ether type) which is a carrier, 2.4 g of ethylene carbonate which is a solvent for modacrylic fiber and 789 g of water was prepared. The results are shown in Table 1.

EXAMPLE 5

The experiment was conducted in the same manner as in Example 1 except that a dyeing solution comprising 11.2 g of Teonol AT (available from Meisei Kagaku Kabushiki Kaisha, aromatic ether type) which is a carrier, 2.4 g of ethylene carbonate which is a solvent for modacrylic fiber and 786 g of water was prepared. The results are shown in Table 1.

EXAMPLE 6

The experiment was conducted in the same manner as in Example 1 except that a dyeing solution comprising 5.6 g of Teonol AT (available from Meisei Kagaku Kabushiki Kaisha, aromatic ether type) which is a carrier, 60.0 g of ethylene carbonate which is a solvent for modacrylic fiber and 734 g of water was prepared. The results are shown in Table 1.

EXAMPLE 7

Using poly(vinyl chloride) fiber (Kanekalon ADR available from Kaneka Corporation, fineness 78 dtex, color number 613), hair bundle 1 of a hair length of 30 cm and weight of 40 g (17,150 fibers) was made. One end of the hair bundle was tied and fixed with cord 2 as illustrated in FIG. 2, and then the hair bundle was hung in the upper part of the dyeing bath 3 by the hanging part 4. A dyeing solution comprising 0.473 owf of Dianix Yellow UN-SE, 0.543 owf of Dianix Red UN-SE and 0.753 owf of Dianix Blue UN-SE which are dispersion dye (all available from Dystar Corporation), totaling 1.75% owf, 0.16 g of Levegar PEW (available from Bayer Ltd., N-alkylphthalimide type) which is a carrier, 10.0 g of dimethylacetamide which is a solvent for poly(vinyl chloride) fiber and 789 g of water, based on 20 g of the hair bundle to be dyed, was produced. This solution was then heated to 74° C. As indicated in FIG. 3, hair bundle 1 which was hung was gradually lowered and dipped 15 cm into the aforesaid dyeing solution. The dipped hair bundle 1 was then dyed for 30 minutes, while applying vibration in an amplitude of 28 mm at a rate of 120 times/minute. After processing, hair bundle 1 was taken out of dyeing bath 3 and washed for 1 minute with warm water of 50° to 60° C. Furthermore, after washing with warm water of 40° to 50° C. with a suitable amount of neutral detergent for domestic use dissolved into it, hair bundle 1 was washed with water and dehydrated. Then, the hair bundle was dried for 40 minutes in an oven (made by Tabai Espec Corporation) of 80° C.

Using this hair bundle, according to the evaluation method mentioned above, the proportion of the remnant dye after dyeing, shrinking, lightfastness and color fastness of rubbing were evaluated. The results are as shown in Table 2.

EXAMPLE 8

The experiment was conducted in the same manner as in Example 7 except that a dyeing solution comprising 0.64 g of Levegar PEW (available from Bayer Ltd., N-alkylphthalimide type) which is a carrier, 10.0 g of dimethylacetamide which is a solvent for poly(vinyl chloride) fiber and 789 g of water was prepared. The results are shown in Table 2.

EXAMPLE 9

The experiment was conducted in the same manner as in Example 7 except that a dyeing solution comprising 1.12 g of Levegar PEW (available from Bayer Ltd., N-alkylphthalimide type) which is a carrier, 10.0 g of dimethylacetamide which is a solvent for poly(vinyl chloride) fiber and 788 g of water was prepared. The results are shown in Table 2.

EXAMPLE 10

The experiment was conducted in the same manner as in Example 7 except that a dyeing solution comprising 1.60 g of Levegar PEW (available from Bayer Ltd., N-alkylphthalimide type) which is a carrier, 10.0 g of dimethylacetamide which is a solvent for poly(vinyl chloride) fiber and 788 g of water was prepared. The results are shown in Table 2.

EXAMPLE 11

The experiment was conducted in the same manner as in Example 7 except that a dyeing solution comprising 11.2 g of Levegar PEW (available from Bayer Ltd., N-alkylphthalimide type) which is a carrier, 10.0 g of dimethylacetamide which is a solvent for poly(vinyl chloride) fiber and 778 g of water was prepared. The results are shown in Table 2.

EXAMPLE 12

The experiment was conducted in the same manner as in Example 7 except that a dyeing solution comprising 1.12 g of Levegar PEW (available from Bayer Ltd., N-alkylphthalimide type) which is a carrier, 60.0 g of dimethylacetamide which is a solvent for poly(vinyl chloride) fiber and 738 g of water was prepared. The results are shown in Table 2.

COMPARATIVE EXAMPLE 1

The experiment was conducted in the same manner as in Example 1 except that a dyeing solution comprising 240 g of ethylene carbonate which is a solvent for modacrylic fiber and 560 g of water was prepared without using Teonol AT (available from Meisei Kagaku Kabushiki Kaisha, aromatic ether type) which is a carrier. The results are shown in Table 1.

COMPARATIVE EXAMPLE 2

The experiment was conducted in the same manner as in Example 1 except that a dyeing solution comprising 5.6 g of Teonol AT (available from Meisei Kagaku Kabushiki Kaisha, aromatic ether type) which is a carrier and 794 g of water was prepared without using ethylene carbonate which is a solvent for modacrylic fiber. The results are shown in Table 1.

COMPARATIVE EXAMPLE 3

The experiment was conducted in the same manner as in Example 7 except that a dyeing solution comprising 200 g of dimethylacetamide which is a solvent for poly(vinyl chloride) fiber and 600 g of water was prepared without using Levegar PEW (available from Bayer Ltd., N-alkylphthalimide type) which is a carrier. The results are shown in Table 2.

COMPARATIVE EXAMPLE 4

The experiment was conducted in the same manner as in Example 7 except that a dyeing solution comprising 1.12 g of Levegar PEW (available from Bayer Ltd., N-alkylphthalimide type) which is a carrier and 798 g of water was prepared without using dimethylacetamide which is a solvent for poly(vinyl chloride) fiber. The results are shown in Table 2.

COMPARATIVE EXAMPLE 5

The experiment was conducted in the same manner as in Example 1 except that a dyeing solution comprising 2.4 g of ethylene carbonate which is a solvent for modacrylic fiber and 798 g of water was prepared without using a carrier. The result was that the fiber was hardly dyed at all.

COMPARATIVE EXAMPLE 6

The experiment was conducted in the same manner as in Example 7 except that a dyeing solution comprising 10 g of dimethylacetamide which is a solvent for poly(vinyl chloride) fiber and 790 g of water was prepared without using a carrier. The result was that the fiber was hardly dyed at all.

TABLE 1

| | Amount of carrier and solvent used (% by weight) | | Condition after dyeing | | Fastness | |
|---|---|---|---|---|---|---|
| | Ethylene carbonate | Teonol AT | Proportion of remnant dye (%) | Shrinking | Color fastness to rubbing dry, wet | Lightfastness |
| Ex. 1 | 0.3 | 0.03 | 95 | ○ | — | — |
| 2 | 0.3 | 0.4 | 30 | ○ | class 5, class 5 | At least class 4 |
| 3 | 0.3 | 0.7 | 17 | ○ | class 5, class 5 | At least class 4 |
| 4 | 0.3 | 1.0 | 2 | ○ | class 5, class 5 | At least class 4 |
| 5 | 0.3 | 1.4 | 0 | Δ | class 5, class 5 | At least class 4 |
| 6 | 7.5 | 0.7 | 5 | Δ | class 5, class 5 | At least class 4 |
| Com. Ex. 1 | 30.0 | None | 80 | X | — | — |
| 2 | None | 0.7 | 50 | ○ | class 4, class 4 | class 4 |

TABLE 2

| | Amount of carrier and solvent used (% by weight) | | Condition after dyeing | | Fastness | |
|---|---|---|---|---|---|---|
| | DMAc | Levegar PEW | Proportion of remnant dye (%) | Shrinking | Color fastness to rubbing dry, wet | Lightfastness |
| Ex. 7 | 1.25 | 0.02 | 95 | ○ | — | — |
| 8 | 1.25 | 0.08 | 10 | ○ | class 5, class 5 | class 4 |
| 9 | 1.25 | 0.14 | 5 | ○ | class 5, class 5 | class 4 |
| 10 | 1.25 | 0.2 | 3 | ○ | class 5, class 5 | class 4 |
| 11 | 1.25 | 1.4 | 0 | Δ | class 5, class 5 | class 4 |
| 12 | 7.5 | 0.14 | 4 | Δ | class 5, class 5 | class 4 |
| Com. Ex. 3 | 25.0 | None | 75 | X | — | — |
| 4 | None | 0.14 | 40 | ○ | class 4, class 4 | Less than class 4 |

It is apparent from Tables 1 and 2 that when a carrier is not used, a large amount of solvent must be used to dye, and as a result, frizzing and embrittlement of the fiber occur. Also, when a solvent is not used, though frizzing of the fiber cannot be seen, color fastness such as color fastness to rubbing and lightfastness decreases. Furthermore, fiber that was dyed once is partially dyed to dye in two colors in the present examples, but it goes without saying that the fiber can be partially dyed further to dye in three colors.

INDUSTRIAL APPLICABILITY

According to the process of the present invention in which a carrier and a solvent for synthetic fiber are used together, a synthetic hair fiber bundle of halogen-containing synthetic fiber can be evenly dyed at a low temperature in a short period. As a result, synthetic hair fiber excellent in fastness, without abnormal shrinking (frizzing) and embrittlement of the fiber due to swelling, can be obtained in an efficient manner. Furthermore, the dyeing process of the present invention is especially useful when the synthetic fiber bundle which has been dyed once is partially dyed further to dye in multiple colors, for example, in the case that the end part of the fiber and the rest of the fiber are to be dyed in different colors (two-tone), as dyeing can be conducted in an extremely short period.

The invention claimed is:

1. A process for dyeing synthetic hair fiber, which comprises dyeing a bundle of synthetic hair fiber made of halogen-containing synthetic fiber by using a dyeing solution containing a dye, a carrier and a solvent for said synthetic fiber at 60° to 90° C., wherein said carrier is used in an amount of 0.05 to 1.2% by weight based on said dyeing solution and said solvent is used in an amount of 0.05 to 5% by weight based on said dyeing solution.

2. The process of claim 1, wherein said halogen-containing synthetic fiber is selected from the group consisting of halogen-containing vinyl fiber and modacrylic fiber.

3. The process of claim 1, wherein a synthetic fiber bundle which is dyed is further dyed partially dye in multiple colors.

4. The process of claim 1, wherein said carrier is at least one member selected from the group consisting of aromatic ether type, aromatic ester type, methyl naphthalene type and N-alkylphthalimide type.

5. The process of claim 1, wherein said solvent is at least one member selected from the group consisting of acetone, ethylene carbonate, tetrahydrofuran, dimethylformamide, dimethylacetamide and dimethyl sulfoxide.

* * * * *